US007473324B2

(12) United States Patent
Siebert

(10) Patent No.: US 7,473,324 B2
(45) Date of Patent: Jan. 6, 2009

(54) CORROSION RESISTANT COATINGS

(75) Inventor: Elizabeth J. Siebert, Birmingham, MI (US)

(73) Assignee: Henkel KGaA (DE)

( * ) Notice: Subject to any disclaimer, the term of this patent is extended or adjusted under 35 U.S.C. 154(b) by 0 days.

(21) Appl. No.: 10/317,947

(22) Filed: Dec. 12, 2002

(65) Prior Publication Data

US 2003/0192624 A1 Oct. 16, 2003

Related U.S. Application Data

(63) Continuation-in-part of application No. 10/117,935, filed on Apr. 8, 2002, now abandoned.

(60) Provisional application No. 60/296,326, filed on Jun. 5, 2001.

(51) Int. Cl.
*C23C 22/34* (2006.01)
*C23C 22/00* (2006.01)

(52) U.S. Cl. ..... 148/257; 148/255; 148/256; 148/274; 106/14.11; 106/14.13; 106/14.41

(58) Field of Classification Search ..... 148/251, 148/274, 246, 255, 256, 257; 427/486; 523/402; 428/416; 106/14.11, 14.13, 14.41
See application file for complete search history.

(56) References Cited

U.S. PATENT DOCUMENTS

| | | | | |
|---|---|---|---|---|
| 4,180,603 | A | 12/1979 | Howell, Jr. | 427/353 |
| 4,233,197 | A | 11/1980 | Howell, Jr. | 260/29 |
| 4,289,826 | A | 9/1981 | Howell, Jr. | 428/418 |
| 4,859,721 | A | 8/1989 | Oberkobusch et al. | 523/402 |
| 5,500,460 | A | 3/1996 | Ahmed et al. | 523/402 |
| 5,753,316 | A * | 5/1998 | Brent et al. | 427/486 |
| 5,868,819 | A * | 2/1999 | Guhde et al. | 106/14.14 |
| 6,096,806 | A | 8/2000 | Mueller et al. | 523/402 |
| 6,165,561 | A * | 12/2000 | Blum et al. | 427/409 |
| 6,645,633 | B2 * | 11/2003 | Weller et al. | 428/418 |
| 2002/0007872 | A1 * | 1/2002 | Cuyler et al. | 148/251 |
| 2003/0104212 | A1 * | 6/2003 | Agarwal et al. | 428/416 |

FOREIGN PATENT DOCUMENTS

| | | |
|---|---|---|
| WO | WO 9707163 | 8/1995 |
| WO | WO 0071337 | 5/2000 |

OTHER PUBLICATIONS

"Metal Surface Treatments", Kirk-Othmer Encyclopedia of Chemical Technology, 4th Edition, vol 16, pp. 436-441 (1992).
"Phosphate Coating", Metal Handbook-Ninth Edition, vol 5, (Surface Cleaning, Finishing and Coating), pp. 434-456 (1982).

* cited by examiner

*Primary Examiner*—Roy King
*Assistant Examiner*—Lois L. Zheng
(74) *Attorney, Agent, or Firm*—Mary K. Cameron

(57) ABSTRACT

Autodeposition of a coating containing an epoxy resin is accomplished over a metal substrate that has been coated with a zinc phosphate conversion coating without significant removal of the zinc phosphate conversion coating.

19 Claims, No Drawings

CORROSION RESISTANT COATINGS

This application is a continuation-in-part of U.S. Ser. No. 10/117,935, filed 8 Apr. 2002, now abandoned, and incorporated herein by reference in its entirely, which claimed the benefit of U.S. Provisional Application Ser. No. 60/296,326, filed 5 Jun. 2001.

FIELD OF THE INVENTION

The invention relates to corrosion resistant coatings which are produced by forming a zinc phosphate conversion coating on a metal surface and thereafter autodepositing a resin layer over the zinc phosphate conversion coating.

BACKGROUND OF THE INVENTION

Autodeposition compositions are used to lay down a film of water resistant resin on a substrate without the use of electricity. One important feature of an autodeposition coating is that the thickness of the film increases over time as the substrate remains in the treatment bath. Contact times within the range of ten seconds to four minutes are commonly used.

Autodeposition compositions are generally in the form of an acidic liquid comprising dispersed resin particles, an oxidizing/and or etching agent, and a surfactant in water with various other additives. Such formulations are thought to follow a deposition mechanism and process by which metal cations are liberated from the substrate and destabilize the dispersion. Once destabilized, the resin particles coalesce and deposit from solution onto the metal substrate to form a coating that is sufficient to withstand gravity and moderate spraying. The wet, uncured coating is typically rinsed, dried, and cured at temperatures above 100° C. to form the final coating.

One of the primary goals for autodeposition coatings is an enhanced resistance to corrosion, as measured by conventional tests. Such tests measure, among other things, the continuity of the deposited film and its adhesion to the substrate.

Substrates that have been previously treated with certain types of phosphate conversion coating (e.g., a zinc phosphate conversion coating) have not performed well with autodeposition coatings. To achieve a satisfactorily rapid rate of autodeposition, it is generally believed necessary to maintain a relatively high concentration of a strong acid. Typically, however, the acid levels of autodeposition compositions are sufficiently aggressive that the zinc phosphate coating is etched from the metal substrate. This stripping effect eliminates the beneficial effects of the zinc phosphate coating and makes it difficult to obtain the cumulative benefits that might be obtained from a zinc phosphate conversion coating that is further protected by an autodeposition coating. Additionally, the zinc and other cations present in the zinc phosphate conversion coating represent a significant source of contaminant ions that can destabilize the autodeposition composition prematurely or cause other undesired effects in the formation or performance of the autodeposited coating.

It would be desirable to have an autodeposition composition and method of application that would permit zinc phosphate conversion-coated substrates to be coated with autodeposition processes. Such an additional coating could also help to form a corrosion resistant surface that was smooth enough to be painted with little or no additional treatment.

It would be particularly beneficial if the corrosion resistance from an autodeposition coating was sufficient that the process did not require the use of a reactive chromium rinse before the film of autodeposited resin was cured. Reactive rinses containing hexavalent chromium were common in the earlier disclosures of the technology but are now disfavored for environmental concerns.

SUMMARY OF THE INVENTION

The invention provides a method of enhancing the corrosion resistance of a metal substrate surface wherein the surface is first treated to form a zinc phosphate conversion coating and then subjected to an autodeposition step wherein a resinous coating is formed on top of the zinc phosphate conversion coating without significant degradation of the zinc phosphate conversion coating.

A process according to the invention includes the step of contacting a surface of a zinc phosphate-coated metal substrate under autodeposition conditions with an autodeposition composition comprising: water, epoxy resin particles (preferably in dispersed form), a cross-linking agent, and a concentration of hydrofluoric acid. The HF concentration during said contacting is controlled within a range effective to cause autodeposition of a coating comprised of said epoxy resin particles on said zinc phosphated-coated substrate without stripping a significant amount of the zinc phosphate conversion coating from said substrate.

The process and composition of the invention can form a tightly adherent epoxy resin coating by autodeposition over a zinc phosphate conversion-coated substrate. Such a coating forms an additional layer of corrosion resistance for further protection of the underlying metallic substrate.

DETAILED DESCRIPTION

Substrates

The present invention can be used to enhance the corrosion resistance of any metallic substrate having a surface which can be treated to form a zinc phosphate conversion coating thereon. Suitable metallic surfaces include steel (including cold rolled steel), galvanized steel (including electrogalvanized steel and hot dipped galvanized steel), aluminum, alloys thereof, and similar metal surfaces. The process of the invention is especially useful for forming corrosion resistant coatings on composite parts. A "composite part" is a workpiece containing two or more different types of metal substrate surfaces. For example, a composite part may contain one section comprised of steel and a second section comprised of aluminum.

Zinc Phosphate Conversion Coatings

The pretreatment step of the present invention utilizes the generically well known process variously called "zinc phosphating", "zinc phosphatizing", or "zinc phosphate conversion coating" in which a metallic substrate is coated with an adherent coating containing phosphate anions and zinc cations.

Normally, a phosphate coating is formed by chemical reaction between the metal substrate and an aqueous liquid variously called a "zinc phosphating" or "zinc phosphatizing" composition, solution, bath, or a like term; in some instances, the formation of the coating may be aided by, or even completely dependent on, application of an electric current. If the phosphating composition is in contact with the substrate for at least about five seconds at a temperature not more than 70° C. and any liquid phosphating composition remaining in contact with the conversion coating thus formed is rinsed off before the substrate treated with it is dried, the zinc phosphate coating formed generally is microcrystalline, particularly if the substrate and/or the phosphating composition contains substantial amounts of zinc. If the phosphating composition is applied to the substrate and dried in place without rinsing, the coating formed is usually predominantly amorphous.

Zinc phosphating is described in the following general sources, incorporated by reference therein in their entirety: "Metal Surface Treatments", *Kirk-Othmer Encyclopedia of Chemical Technology,* $4^{th}$ Edition, Volume 16, pp. 436-441 (1992); "Phosphate Coating", *Metals Handbook-Ninth Edition*, Volume 5 (Surface Cleaning, Finishing and Coating), pp. 434-456 (1982).

Suitable zinc phosphate conversion coatings for purposes of the present invention include, but are not limited to, calcium-, nickel-, and manganese-modified zinc phosphate coatings. Liquid concentrates and powders for a wide variety of conversion coatings suitable for use in the invention are available under the BONDERITE trademark from the Surface Technologies division of Henkel Corporation.

The zinc phosphating process cycle to which the metal substrate is subjected may comprise one or more of the following steps (in addition to the required contacting with the working zinc phosphate composition):

Cleaning of the surface of the metal substrate using one or more cleaning agents;

Rinsing to remove the cleaning agents used in (a);

Pretreatments other than phosphating (e.g., application of "Jernstedt salts" to condition the metal substrate surface);

Rinsing of the metal carrier surface coated with the working zinc phosphate composition (water rinse and/or other after-treatment rinse);

Drying.

A composition used to form the conversion coating on the metal substrate according to the invention must contain phosphate anions. They may be supplied to the composition by any oxyacid of phosphorus, or water-soluble salt thereof, in which the phosphorus is in its +5 valence state, i.e., orthophosphoric acid, metaphosphoric acid, and the condensed phosphoric acids corresponding to the general formula $H_{(n+2)}P_nO_{(3n+1)}$, where n represents a positive integer with a value of at least 2. As is generally known in the art, these species are all believed to exist in equilibrium with one another, with the equilibrium strongly favoring the more condensed acids, including metaphosphoric acid, and/or their salts at higher temperatures and concentrations. At least for reasons of economy, simple orthophosphoric acid, for which the chemical formula is $H_3PO_4$, and/or at least one salt thereof, is normally preferred as the source for the phosphate ions.

A working zinc phosphating composition used to prepare the desired conversion coating also contains zinc cations, which may be supplied to the composition by dissolving therein any suitable zinc salt or a combination of acid and elemental zinc, zinc oxide, or zinc hydroxide. If a substrate being coated is predominantly elemental zinc, an adequate and even a preferred amount of zinc can be dissolved into the working composition from the substrate before the working composition dries. Normally, however, in order to avoid substantial variations in coating quality, it is preferred to provide zinc cations in a controlled concentration to the working composition before the latter is contacted with the substrate to be coated. For convenience, freedom from contaminants that can cause quality problems in the coatings formed, and economy, either zinc oxide or zinc dihydrogen phosphate is preferred as a source of zinc ions for the working compositions.

The working zinc phosphating composition may also contain manganese cations. The most preferred source for these manganese cations is manganous oxide, which dissolves in acidic aqueous solutions to supply manganese cations.

Independently, the working zinc phosphating composition may also contain nickel cations, the preferred source of which is nickel phosphate.

In one embodiment of the invention, the working zinc phosphating composition contains both manganese and nickel cations in addition to phosphate anions and zinc cations.

Independently, the working zinc phosphating composition used in the invention may additionally contain at least one of (i) hydroxylamine, in free or bound form and (ii) iron cations. Any iron cations present preferably are predominantly in the ferrous oxidation state, inasmuch as ferrous phosphate is considerably more water soluble than ferric phosphate. Any iron salt or oxide, or even iron metal (which will dissolve in acidic solutions, accompanied by hydrogen gas evolution) may be used as the source; ferrous sulfate is most preferred for convenience and economy.

Instead of iron cations, hydroxylamine may be used at least equally preferably. Oximes can also serve as a suitable source of hydroxylamine. Hydroxylamine sulfate is most preferred for economy and because sulfate is believed to contribute to the storage stability of highly concentrated phosphating compositions.

The working composition used for phosphating may also contain any of the additional divalent cations cobalt, magnesium, calcium, copper, and the like and combinations thereof, often found useful in conventional zinc phosphating compositions.

When the substrates (carriers) to be treated are predominantly zinciferous or similarly electrochemically active, no accelerator is generally needed in the phosphating composition, while if the substrates are predominantly ferriferous, an accelerator may be advantageous. Adequate guidance as to suitable accelerators is provided by the prior zinc phosphating art. For example, a dissolved accelerator component may consist of at least one of: chlorate ions; nitrite ions; m-nitrobenzoate ions; p-nitrophenol; hydrogen peroxide in free or bound form; hydroxylamine in free or bound form; and reducing sugars.

The working zinc phosphating composition may be applied to a metal work piece (substrate) by any convenient method, several of which will be readily apparent to those skilled in the art. For example, coating the metal with a liquid film may be accomplished by immersing the surface in a container of the liquid composition, spraying the composition on the surface, coating the surface by passing it between upper and lower rollers with the lower roller immersed in a container of the liquid composition, and the like, or by a mixture of methods. Excessive amounts of the liquid composition that might otherwise remain on the surface prior to drying may be removed by any convenient method, such as drainage under the influence of gravity, squeegees, passing between rolls, and the like.

In preferred embodiments of the invention, the weight of the zinc phosphate conversion coating on the metal substrate surface is at least 1500 $mg/m^2$. More preferably, the zinc phosphate conversion coating weight is at least 1700 $mg/m^2$. Most preferably, the zinc phosphate conversion coating weight is at least 1900 $mg/m^2$. The coating weight of the zinc phosphate conversion coating can be controlled as desired by varying the concentrations of the components of the zinc phosphate conversion coating composition, contact time, contact temperature and other parameters, in accordance with procedures known in the art.

Autodeposition Compositions

The autodeposition composition used in the present invention is an acidic liquid comprising: water, epoxy resin particles, a crosslinking agent, and a concentration of hydrofluoric acid that is effective to etch a target metallic substrate surface having a zinc phosphate conversion coating thereon without reducing the zinc phosphate conversion coating weight to a point where the corrosion resistance is adversely affected to an unacceptable extent and/or without increasing the concentration in the autodeposition composition bath of species derived from the zinc phosphate conversion coating to a point where the autodeposition performance of the bath is affected to an unacceptable or where the contents of the bath need to be treated to remove or reduce such species at unacceptably frequent intervals. The reduced concentration of hydrofluoric acid called for in the present invention relative to prior processes allows an autodeposited epoxy coating to form on a conversion coated metallic surface without stripping detrimental levels of the zinc phosphate conversion coating from the substrate. This result was quite surprising, as it had earlier been believed that operating an autodeposition process at such reduced HF levels would result in impracticably slow rates of film build and/or limit the thickness of the autodeposited coating capable of being formed in such a process.

Epoxy Resin

The presence of epoxy resin particles in the autodeposition composition helps to significantly improve the adhesion of the autodeposited coating to the zinc phosphate-coated metallic substrate. For example, autodeposition compositions based on dispersed particles containing acrylic resin but no epoxy resin have been found to provide coating films exhibiting poor adhesion to zinc phosphate conversion-coated substrates. However, resins other than epoxy resins can be used in combination with one or more epoxy resins. Suitable co-resins include, for example, acrylic resins and polyurethane resins.

Useful autodeposition resins useful in the present invention can be based on one or more epoxy resins which are capable of satisfactory use in an autodepositing water-based coating composition and contain one or more hydroxyl groups that are reactive to isocyanate groups. Such epoxy resins are well known substances and are described, for example, in the chapter entitled "Epoxy Resins" in Volume 6 of The Encyclopedia of Polymer Science and Engineering (Second Edition). Particularly suitable epoxy resins are described in the following publications, each of which is incorporated herein by reference in its entirety: U.S. Pat. Nos. 4,233,197; 4,180,603; 4,289,826; 4,859,721; 5,500,460; and 6,096,806 and WO 00/71337. Other suitable epoxy resins are described in U.S. Ser. Nos. 09/578,935 (filed May 25, 2000) and 09/964,181 (filed Sep. 25, 2001), each incorporated herein by reference in its entirety.

Satisfactory autodeposited coatings for most purposes can be produced when molecules containing at least two 1,2-epoxide moieties are substantially the only epoxy resins used in the composition. If desired, blends of the epoxy resin with other types of polymers can be used. Examples of polymeric blends include acrylic polymers containing some acrylic acid monomer residues which can react with the hydroxyl groups on epoxy resins to form ester groups and thereby crosslink the polymer coating formed by autodeposition.

Epoxy resins for the invention are often described by the type of central organic moiety or moieties to which the 1,2-epoxy moieties are attached. Non-exclusive examples of such central moieties are those derived from bis-phenol A and its analogs in which one or two —$NH_2$ moieties are substituted for an equal number of —OH moieties in bis-phenol A; novolak condensates of formaldehyde with phenol and substituted phenols and their amino analogs, the condensates containing at least two aromatic nuclei; triazine; hydantoin; and other organic molecules containing at least two hydroxyl and/or amino moieties each, in each instance with as many hydrogen atoms deleted from hydroxy and/or amino moieties in the parent molecule as there are epoxy moieties in the molecules of epoxy resin. Optionally, the 1,2-epoxide moieties may be separated from the central moieties as defined above by one or more, preferably only one, methylene groups. Oligomers of such monomers, either with themselves or with other organic molecules containing at least two hydroxyl and/or amino moieties each, may also serve as the central organic moiety.

Epoxy resins useful for the present invention include glycidyl ethers of a polyhydric phenol; bisphenol A (a particularly preferred species of polyhydric phenol), bisphenol F, bisphenol AD, catechol, resorcinol, and the like. It will generally be desirable to utilize, at least in part, epoxy resins of the type which have relatively low epoxide equivalent molecular weights (e.g., about 75 to about 300) and/or which are liquid at ambient temperatures.

Primarily for reasons of economy and commercial availability, it is generally preferred to utilize epoxy resins derived from bis-phenol A in this invention. More particularly, epoxy moiety-containing molecules utilized in this invention preferably conform to general chemical formula:

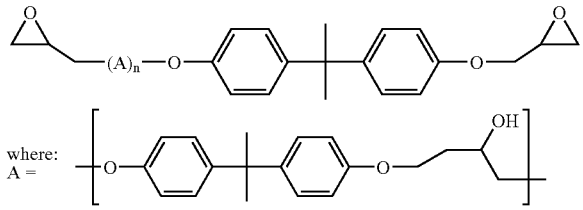

and "n" is an integer from 0 to 50. Preferably, n is an integer within the range from about 1-30.

Also useful in the present invention are chain-extended epoxy resins containing flexibilizing segments derived from flexibilizing epoxy resins, such as those described in copending application Ser. No. 09/578,935, filed on May 25, 2000 (corresponding to published International application WO 00/71337), the disclosure of which is herein incorporated by reference in its entirety. As described in that application, a "flexibilizing epoxy resin" may be defined as an epoxy resin which when cured by itself with diethylene triamine (DETA) has aurometer Shore D reading not greater than 45. Suitable flexibilizing epoxy resins include those compounds containing at least one epoxide group per molecule and one or more groups capable of increasing the flexibility of the cured autodeposited coating such as, for example, long aliphatic chains (e.g., polymethylene chains corresponding, for example, to the structure —$(CH_2)_n$— wherein "n" is preferably greater than 3, more preferably greater than 6. The polymethylene chains can be in the backbone of the flexibilizing epoxy resin and/or pendent thereto), polyester chains (especially those formed by condensation of aliphatic diacids and glycols or glycol oligomers), polyoxyalkylene chains (e.g., polyether chains corresponding to the structure —$((CH_2)_n$—CHR—O—$)_m$—, where: "n" is 0-3, "m" is 2 or greater, and R is H or alkyl), and the like. A particularly preferred flexibilizing epoxy resin is a difunctional epoxy derived from cardanol (a phenol substituted with a long chain unsaturated hydrocarbon group which is obtained from cashew nut oil) having an epoxy equivalent weight of about 350.

In chain-extended resins, a chain extender is utilized to react individual epoxy resin molecules through their epoxy groups so as to form a polymer which is higher in average molecular weight than the starting epoxy resin(s). For reasons that are not well understood, "pre-reacting" the epoxy resin(s) in this manner leads to improvements in the quality and performance of the final autodeposited coating as compared to simply using a dispersion of the epoxy resin(s) in unreacted form. This is particularly true where at least one of the epoxy resins is a flexibilizing epoxy resin. In one embodiment of the invention, the average molecular weight is increased at least 100%, more preferably at least about 200%, relative to the initial average molecular weight of the starting epoxy resin or combination of epoxy resins. The chain extender thus should contain at least two functional groups capable of reacting with said epoxy group such as, for example, hydroxy, carboxylic acid, carboxylic acid anhydride or the like. In one embodiment of the invention, the chain extender is a polyhydric phenol such as bisphenol A. Alkoxylated polyhydric phenols such as SYNFAC 8009 (available from Milliken Chemical) may also be used as chain extenders. Suitable chain extenders additionally include dicarboxylic acids such as adipic acid.

Alternatively, a diglycidyl ether of a polyhydric phenol such as bisphenol A is used in combination with a chain extender which contains one or more flexibilizing segments such as polymethylene, polyester or polyoxyalkylene segments. For example, a polyether polyol such as polypropylene glycol, polyester polyol (hydroxy and/or carboxylic acid terminated), dimer fatty acid, long chain dicarboxylic acid (e.g., decanedioic acid), long chain diol (e.g., 1,12-decanediol), or the like could be used.

The stoichiometry of chain extender(s) to epoxy resin(s) is adjusted depending upon the degree of condensation (i.e., chain extension) desired in forming the chain-extended epoxy resin. Typically, however, the amount of epoxy resin(s) is kept in slight to moderate excess relative to the amount of chain extender(s). For example, the equivalents of epoxy groups in the epoxy resin(s) may be about 5% to about 50% greater than the equivalents of active hydrogen groups in the chain extender(s). The polymer formed thus will contain unreacted epoxy groups (i.e., the polymer will be epoxy-functionalized). Typically, the polymer will also contain hydroxy (—OH) groups, which may be present in the initial epoxy resin(s) or which may be formed as a consequence of the reaction between the chain extender and the epoxy groups of the epoxy resin.

The epoxy resin(s) and chain extender(s) are reacted for a time and at a temperature effective to cause the desired degree of condensation and chain extension. In one embodiment of the invention, for example, the epoxide equivalent weight of the chain-extended epoxy resin formed will be in the range of at least about 1000, preferably at least about 1500, as compared to epoxide equivalent weights for the starting epoxy resin reactant(s) of from about 75 to about 500. Such conditions will vary depending upon the relative reactivity of the components and other factors, but may be optimized without undue experimentation.

Catalysts capable of accelerating the desired epoxy group reaction with the chain extender such as phosphines, amines and other basic substances may be utilized if so desired in order to reduce the reaction time and/or temperature required. The reaction may be carried out in the presence of a solvent capable of dissolving both the epoxy resin(s) and the chain extender(s) such as, for example, an inert organic solvent (e.g., aromatic hydrocarbons, ketones). It is recognized that in certain embodiments of the invention, some portions of the starting materials may remain unreacted and thus may be present in such form when the chain-extended epoxy resin dispersion is used in an autodeposition bath.

To prepare epoxy resin emulsions suitable for use in the present invention, a solution of the epoxy resin in one or more organic solvents is emulsified with water in the presence of one or more emulsifiers to form an organic solvent-containing intermediate emulsion. The organic solvent(s) used in said emulsification step may be the same as or different from the organic solvent(s) used when reacting the epoxy resin(s) and chain extender(s) as described hereinabove. Other desired components such as cross-linkers, coalescing agents, flow control additives (levelling agents), and the like may also be incorporated into the emulsion, either as components pre-dissolved in the organic (solvent) phase or added separately to the emulsion.

Self-emulsifying epoxy resins, such as epoxy resins which have been modified with anionic functional groups (as described, for example, in U.S. Pat. No. 4,859,721) are also suitable for use in the present invention, thereby avoiding the need to incorporate separate emulsifiers in the autodeposition composition.

The emulsion may be further treated or processed so as to modify the particle size or particle size distribution of the dispersed epoxy resin and other components.

The solids (non-volatile) content of the autodeposition composition when contacted with the zinc phosphate conversion-coated metal substrate is typically within the range of from about 1 weight percent to about 25 weight percent.

Crosslinking Agent

The crosslinking agent used in the present invention reacts with the epoxy resin (typically, through epoxide or hydroxyl moieties present in the epoxy resin) at the elevated temperatures used to cure the autodeposited coating, e.g., at least 1000 ° C. The crosslinking agent may be chemically incorporated into the epoxy resin component (i.e., "internal hardeners" such as masked or blocked isocyanate groups may be used, as described, for example, in U.S. Pat. No. 4,859,721 and U.S. Ser. No. 09/944,267, filed Aug. 31, 2001), each of which is incorporated herein by reference in its entirety. The "epoxy resin" and "crosslinking agent" components required to be present in the autodeposition compositions used in the present invention thus may be supplied in the form of a single chemical species.

Examples of suitable crosslinking agents include compounds that contain: (a) at least two functional groups capable of reacting with the functional groups (typically, hydroxyl and/or epoxy groups) present in the epoxy resin component of the autodeposition composition, such as amine, amide, imine, thiol, hydroxyl, carboxyl, and carboxylic acid anhydride, and (b) molecules that contain at least two blocked isocyanate groups, each such group being blocked with a conventional blocking agent or internally blocked by formation of a uretdione structure, so that the blocked isocyanate group does not react at any appreciable rate at room temperature with hydroxyl or epoxy groups but does react rapidly with such groups after being unblocked by heating. Examples of such blocked isocyanates are described in U.S. Pat. No. 6,096,806, the disclosure of which is herein incorporated by reference.

Briefly described, the blocked isocyanates of U.S. Pat. No. 6,096,806 are preferably chosen from molecules that conform to general formula:

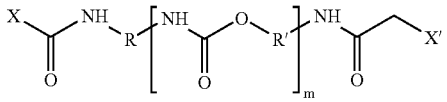

wherein:

each of X and X' independently is a monovalent moiety formed by removing the most easily ionized hydrogen atom from an amine, alcohol, amide, or oxime molecule, or B and B' are joined to each other to form a uretdione;

each of R and R' independently is a divalent hydrocarbon or carbonyl-hydrocarbon moiety derived by removing from any hydrocarbon, or from an oxyhydrocarbon in which all oxygen atoms present are in carbonyl groups, any two hydrogen atoms not attached to the same carbon atom, said divalent hydrocarbon or carbonyl-hydrocarbon moiety having from 2 to 20 carbon atoms and having no unsaturation except aromatic and carbonyl unsaturation; and m is an integer from 0-20, preferably, within the range of 1-15.

The blocking groups X and X', which preferably are the same or are joined to form a uretdione, can be derived from any suitable aliphatic, cycloaliphatic, aromatic, or alkylaromatic monoalcohol, monoamide, monoamine, or monooxime. Ketoximes are especially useful when unblocking at relatively low temperatures such as 120° C. is desired. More sterically hindered and/or more acid stable blocking groups, such as those derived from the lactam of 6-aminohexanoic acid and/or benzotriazole are preferred if unblocking is desired to begin at a substantial rate only at or above 160° C.

Suitable cross-linkers of these types are described, for example, in U.S. Pat. No. 5,500,460 and WO 97/07163. The use of isophorone diisocyanate-based, epsilon-caprolactam blocked isocyanates as crosslinker, such as the product sold by Huels under the trademark VESTAGON B1530, is particularly preferred. If a blocked isocyanate-type crosslinker is utilized, the ratio of blocked isocyanate groups to hydroxy groups (NCO:OH) typically will be in the range of about 0.05 to about 1.2, more preferably about 0.1 to about 0.5. Other examples include blocked hexamethylene diisocyanates (HMDI).

Another type of crosslinking agent suitable for use in the present invention has functionality of both a low temperature crosslinking agent (for prepolymer formation at ambient or slightly elevated temperatures) and a high temperature crosslinking agent (capable of reacting with the epoxy resin component only at temperatures of 100° C. or higher, for example). One such crosslinker has the general structure of:

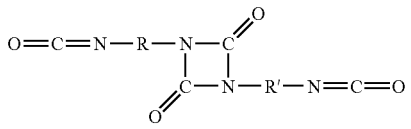

wherein:

R and R' are independently selected from aliphatic, cycloaliphatic, aromatic, or alkylaromatic monoalcohol, monoamide, monoamine, or monooxime having from 1-20 carbon atoms. This type of "hybrid" crosslinking agent and its use in an epoxy resin-based autodeposition composition is described in detail in U.S. Ser. No. 09/944,267, filed Aug. 31, 2001, incorporated herein by reference in its entirety.

Hydrofluoric Acid

The amount of hydrofluoric acid used in the autodeposition composition is critical and should be sufficient to cause autodeposition of epoxy resin particles onto the metal substrate surface but not so high that the zinc phosphate conversion coating is either removed or reduced to an ineffective level. Generally speaking, it is preferred that the weight of the zinc phosphate conversion coating following the autodeposition step of the present invention be at least 1500 mg/m$^2$, more preferably at least about 1700 mg/M$^2$, most preferably at least about 1900 mg/m$^2$. The autodeposition conditions are preferably controlled such that the weight of the phosphate conversion coating on the metal substrate surface is reduced by no more than 20% (more preferably, no more than 15%; most preferably, no more than 10%) during autodeposition (as measured by comparing the phosphate conversion coating weight immediately before contacting the metal substrate surface with the autodeposition composition with the coating weight after any post-rinse of the autodeposited coating but before curing such autodeposited coating).

Suitable hydrofluoric acid concentration levels for the present invention are generally amounts lower than those generally useful for bare metal substrates. In general, hydrofluoric acid is used in an amount within the range from about 0.22 to about 0.60 g/l, and more preferably within an amount from about 0.30 to about 0.55 g/l. The conditions during the autodeposition step of the present invention (i.e., when the autodeposition composition is in contact with the phosphate conversion-coated metallic substrate) are preferably maintained such that the reading on a LINEGUARD™ 101 meter (obtainable from the Surface Technologies Division of Henkel Corporation, Madison Heights, Mich.) is within the range from about 50 microamps to about 200 microamps, more preferably from about 75 microamps to about 190 microamps. A LINEGUARD 101 meter measures active fluoride levels in acidic solutions using a fluoride-sensitive electrode. As the LINEGUARD 101 meter reading may be affected by the presence of certain species other than HF in the autodeposition composition, the aforestated preferred minimum and maximum LINEGUARD 101 meter readings are based on the assumption that HF is the only species present in the autodeposition composition which is being measured by the LINEGUARD 101 meter. Under such conditions, the correlation between HF concentration and the LINEGUARD 101 meter reading was measured as follows: LINEGUARD 101 METER (microamps) HF Concentration (g/L)

| | |
|---|---|
| 20 | 0.1 |
| 40 | 0.2 |
| 75 | 0.3 |
| 120 | 0.4 |
| 160 | 0.5 |
| 280 | 0.75 |
| 370 | 1.0 |

As an autodeposition composition is being used over an extended period of time, the hydrofluoric acid concentration may tend to drop below the desired concentration range due to chemical reactions (e.g., neutralization) or drag-out. It thus may be necessary to replenish the amount of hydrofluoric acid present by periodically adding an appropriate quantity of HF to the operating bath containing the autodeposition bath.

The required concentration of hydrofluoric acid in the autodeposition composition may be obtained through the introduction of HF itself or by the in situ generation of HF by the reaction of other species.

Although other acids can be used in combination with hydrofluoric acid, the acidity of the autodeposition composition must be controlled so as to avoid excessive removal of the zinc phosphate conversion coating as described hereinabove.

Auxiliary Activating Agents

The autodeposition composition preferably contains one or more auxiliary activating agents (which are also sometimes referred to as "accelerating agents" or "accelerators") in addition to hydrogen fluoride which act to destabilize the epoxy resin dispersion and facilitate autodeposition of a coating containing the epoxy resin and crosslinking agent. Preferred activating agents include soluble ferric ions (trivalent iron ions). Hydrogen peroxide is another preferred activating agent and may be advantageously used in combination with ferric ions. Other suitable activating agents include, but are not limited to, salts of hydrofluoric acid, fluosilicic acid and its salts, fluotitanic acid and its salts, organic acids such as acetic acid and citric acid and their salts, peroxy acids, mineral acids such as sulfuric acid, nitric acid, and phosphoric acid, and combinations and mixtures thereof.

The types and concentrations of the auxiliary activating agents present in the autodeposition composition are preferably selected such that, in combination with the amount of hydrofluoric acid present, the autodeposition composition has an oxidation potential, as measured by the potential of a platinum or other inert metal electrode in contact with the autodeposition composition, when used to coat the phosphate conversion-coated metal substrate that is preferably at least 100 mV (more preferably at least 300 mV) more oxidizing than a standard hydrogen electrode (SHE) and preferably is not more than 550 mV (more preferably not more than 500 mV) more oxidizing than a SHE.

Optional Ingredients

Optional ingredients can be added to the autodeposition composition as desired, including any of the components of autodeposition compositions known in the art. Illustrative optional ingredients include, for example, UV stabilizers, viscosity modifiers, flow modifiers, coalescing agents, solvents, fillers, pigments, surfactants (to help maintain the epoxy resin particles in dispersed form), etc. Further details on such components, including preferred materials and concentrations, may be found in the following publications and pending applications, each of which is incorporated herein by reference in its entirety: U.S. Pat. Nos. 4,233,197; 4,180,603; 4,289,826; 4,859,721; 5,500,460; and 6,096,806; WO 00/71337; and U.S. Ser. Nos. 09/578,935 (filed May 25, 2000), 09/964,181 (filed Sep. 25, 2001), and 09/944,267 (filed Aug. 31, 2001).

Autodeposition Process

The autodeposition step used in this invention may comprise the steps of:

contacting an object with a zinc phosphate conversion-coated metal surface with the aforedescribed autodeposition composition for a sufficient time to cause the formation of a film of the epoxy resin and crosslinking agent (which film may also contain certain other components of the autodeposition composition) of a pre-determined thickness on the metal surface, separating the coated metal surface from contact with the autodeposition composition, optionally, rinsing the coated metal surface to remove at least some of the absorbed but otherwise unadhered components of the autodeposition composition from the more adherent portion of the coating, and heating the rinsed surface to form a cured film.

Without wishing to be bound by theory, it is believed that when the wet adherent coating is heated, the epoxy resin and crosslinker in the autodeposited film react to form a thermoset polymeric matrix.

Ordinarily, the zinc phosphate conversion-coated metal surface will not require any special preconditioning or other treatment prior to being contacted with the autodeposition composition. If, however, such surface has become contaminated after zinc phosphating, it preferably is cleaned, degreased and/or rinsed with water before being subjected to autodeposition. Conventional techniques for cleaning and degreasing the metal surface may be used, provided that exposure to conditions or reagents that would result in removal of the zinc phosphate conversion coating should be avoided (e.g., washing with a strong aqueous acid).

Any method can be used for contacting a zinc phosphate conversion-coated metal surface with the autodeposition composition. Examples include immersion, spraying or roll coating, and the like. Immersion is usually preferred.

Preferably, contact between a zinc phosphate conversion-coated metal surface and the autodeposition composition is for a time between about 0.5 and about 10 minutes, more preferably between about 1 and about 3 minutes. Contact preferably is long enough to produce a final film thickness of from about 5 to about 50 microns. The temperature of the autodeposition composition during this contacting step is riot believed to be particularly critical, but typically may be about room temperature (e.g., about 20 to about 30 degrees C.).

Rinsing

The resin-coated substrate can be rinsed before significant drying takes place to remove residual components, such as acid and other ingredients of the autodeposition composition that adhere to the coated surface. If such residual materials are allowed to remain on the coated surface, they may change or adversely affect the quality of the coating. Water rinsing is typically performed with tap or deionized water. The residual materials can be removed or rendered unreactive by treatment with an alkaline solution suitably a mild alkaline solution, for example, a solution of about 0.1 to about 2 g/l of caustic. If removal of the residual components is not necessary, water rinsing need not be employed.

Optionally, a reagent capable of causing additional desirable reactions in or modifications of the coated film may be included in the rinse used after cessation of contact between the wet coated surface and the bulk of the autodeposition bath composition. Such a reagent may also be brought into contact with the wet coated film after rinsing with water alone. Although the autodeposition compositions described herein generally produce wet coated films that can be heated after simple rinsing with tap or deionized water to give good quality final films, the corrosion resistance of the cured coating may be further improved by rinsing with an aqueous solution of an alkaline earth metal compound such as calcium nitrate as described in U.S. application Ser. Nos. 09/557,534, filed Apr. 25, 2000 (published as US2002/0076498) and 09/990,066, filed Nov. 21, 2001 (published as US2002/0102356), each of which is incorporated herein by reference in its entirety.

Curing

The coating should be cured to form the desired corrosion resistant resinous film on the zinc phosphate conversion-coated substrate. In general, the coating can be cured at conditions suitable to react the particular combination of epoxy resin and crosslinking agent employed. Exemplary conditions used in curing coatings produced according to the present invention are temperatures within the range of about 100° C. to 300° C. for periods of time within the range of about 10 to about 30 minutes, depending on the mass of the coated substrate. Generally, the final heating temperature is selected to dry and cure the coating at a temperature within the range from at least about 100° C. to about 300° C., more preferably between about 130° C. and 240° C., for a time of about 3 to about 60 minutes.

The heating can be performed in multiple stages, if desired. For example, in a first stage lasting from about 5 to about 15 minutes, the coated substrate is heated to a peak temperature of 55° C. to 65° C. to flash off most of the residual water in the coating and in a second stage lasting from about 30 to about 50 minutes, the coated substrate is heated to a peak temperature of 185° C. to 195° C.

When baked in an oven, the coating reaches the proper "curing" temperature when the substrate reaches the oven temperature. For this reason, parts that are constructed of thicker steel require longer times to cure. Massive parts may have difficulties reaching the required temperature without adversely affecting the coating. In some cases, it is possible to overcome limitations with convection heating by infrared radiation curing. Infrared radiation curing is, however, only practical for simple geometric shapes because all surfaces must be visible to the infrared source.

The cured coating of the present invention will have good adhesion to the substrate and provide a level of corrosion resistance higher than the original conversion coated surface. The corrosion resistance of the substrate will also be improved as compared to a substrate which has not been treated with a zinc phosphate conversion coating composition prior to autodeposition.

Application of Additional Paint Coating

In one embodiment of the invention, a conventional paint coating is applied over the autodeposited coating by electrodeposition, preferably after rinsing but before curing the autodeposited coating. Electrodeposition compositions (paints) and conditions known in the art may be used for this purpose. The electrodeposited paint coating could be a primer or pigment (color) containing coating. A particular advantage of the present invention is that the presence of the autodeposited coating on the metallic substrate surface facilitates the formation of an extremely smooth and uniform electrodeposited paint coating. Other methods of applying a paint layer onto the autodeposited coating could also be used, however, including for example spraying, brushing, rolling, or powder painting.

Uses

The process of the present invention can be used for treating surfaces of iron, zinc, iron alloys and zinc alloys, and particularly steel portions of various components such as vehicle sheet components and vehicle components such as frames, cross members, engine mounts, brake components, seat tracks, seat mechanisms, shock absorbers, jacks, leaf springs, suspension components, brackets, and the like, components of furniture such as drawer rails, and the like, construction components and appliance components.

EXAMPLES

Panels made of different metals were treated with various phosphate pretreatments, followed by applications of autodeposited resinous films. In some cases, a further coating was applied by electrodeposition.

Materials

Test panels fabricated of cold-rolled steel (hereinafter referred to as "CRS"), electro-galvanized steel ("EG"), and aluminum 6111 T4 alloy ("AL") were purchased from ACT Laboratories, Hillsdale, Mich. PARCO Cleaner ("PCL") 1523, FIXODINE ("Fix") Z-8, BONDERITE ("B") 958, PARCOLENE ("PLN") 90, AUTOPHORETIC Coating Chemical ("ACC") 901 (composition containing dispersed epoxy resin particles) and AUTOPHORETIC Starter 300 (all products of the Henkel Surface Technologies Division of Henkel Corporation, Madison Heights, Mich.) were taken from laboratory stock. Electrodeposition primer ED-5050B was obtained from PPG Industries. A second epoxy resin dispersion was prepared according to Formula A:

TABLE 1

Formula A Epoxy Resin Dispersion

| Ingredient | Parts By Weight | Description | Manufacturer |
|---|---|---|---|
| PB-8990 | 2100.9 | Epoxy resin | Henkel Surface Technologies |
| VESTAGON B1530 | 254.3 | Blocked isocyanate crosslinker | Huels |
| TEXANOL | 101.2 | Coalescesing solvent | Eastman |
| Methylisobutylketone | 1277.4 | Dispersing solvent | |
| RHODAPEX CO 436 | 76.6 | Surfactant | Rhone Poulenc |
| Deionized Water | 5189.6 | Solvent | |
| Total | 9000.0 | 17.8% solids | |

The first four ingredients were combined and the resulting mixture then poured into a mixture containing the surfactant and deionized water. The mixture thus obtained was then run twice through a microfluidizer. Methyl isobutyl ketone and water were removed by azeotropic distillation at about 190-212° F. until a solids level of about 25-27% was achieved.

The autodeposition compositions were prepared according to the following formulas (the amount being in grams, unless otherwise noted):

TABLE 2

Autodeposition Compositions

| Ingredient | Composition 123-1 | Composition 127-1 |
|---|---|---|
| DI water | 3000 | 3000 |
| ACC 901[1] | 3000 | 0 |
| Formula A | 0 | 3000 |
| ACC Starter 300 | 295 (+30 ml 5% HF) | 295 (+20 ml 5% HF) |
| % solids | 12.1 | 12.0 |
| Fe titration | 22-24 | 22-24 |
| Redox Potential | 475 mV | 490 mV |
| Hydrogen Fluoride Level (LINEGUARD 101 meter reading) | ca. 0.52 g/L (170 microamps) | ca. 0.50 g/L (160 microamps) |

[1]Processed by azeotropic distillation to provide solids level of 25%

Procedures

Autodeposition compositions 123-1 and 127-1 were operated as immersion baths generally in accordance with Henkel Surface Technologies' Technical Process Bulletin for AUTOPHORETIC 901 Coating Chemical, which is incorporated by reference herein in its entirety. The redox condition of the autodeposition composition was monitored with a platinum oxidation reduction potential electrode. The fluoride level in the autodeposition composition was monitored with a LINEGUARD 101 meter. Surface tension was measured using the Kruss K-12 Tensiometer in the Wilhelmy Plate mode.

Results and Discussion

Coating Processes

Three coating sequences were tested for effectiveness as pretreatment and primer systems for cold rolled steel (CRS), electrogalvanized steel (EG) and aluminum (AL). All panels were coated using one of the following procedures:

Comparative Process A (Zinc Phosphating Process Plus ED Primer)

| Step No. | Task | Description |
|---|---|---|
| 1 | Clean | PARCO Cleaner 1523, 5-7 pts, 120° F., 90 sec |
| 2 | Rinse | Warm water rinse, 120° F., 30 sec |
| 3 | Condition | FIXODINE Z8, 1.5 g/l, pH = 8.8-9.0, 100° F., 30 sec |
| 4 | Phosphate | BONDERITE 958, FA = 0.6, TA = 22.6, $F^-$ = 120 μa, 120° F., 120 sec |
| 5 | Rinse | Cold water rinse, 65° F., 30 sec |
| 6 | Post-rinse | PARCOLENE 90, pH = 5.6, concentration = 15 ml, 30 sec |
| 7 | Deionized post-rinse | Deionized water rinse, 30 sec |
| 8 | Electrocoat paint | ED-5050B cationic electrocoat primer |
| 9 | Cure | |

Process B (Invention)

| Step No. | Task | Description |
|---|---|---|
| 1 | Clean | PARCO Cleaner 1523, 5-7 pts, 120° F., 90 sec |
| 2 | Rinse | Warm water rinse, 120° F., 30 sec |
| 3 | Condition | FIXODINE Z8, 1.5 g/l, pH = 8.8-9.0, 100° F., 30 sec |
| 4 | Phosphate | BONDERITE 958, FA = 0.6, TA = 22.6, $F^-$ = 120 μa, 120° F., 120 sec |
| 5 | Rinse | Deionized Water Rinse, 65° F., 30 sec |
| 6 | Autodeposit | Autodeposition composition 123-1 or 127-1 |
| 7 | Post-rinse | Deionized water rinse, 65° F., 30 sec |
| 8 | Electrocoat paint | ED-5050B cationic electrocoat primer |
| 9 | Cure | |

Process C (Invention)

| Step No. | Task | Description |
|---|---|---|
| 1 | Clean | PARCO Cleaner 1523, 5-7 pts, 120° F., 90 sec |
| 2 | Rinse | Warm water rinse, 120° F., 30 sec |
| 3 | Condition | FIXODINE Z8, 1.5 g/l, pH = 8.8-9.0, 100° F., 30 sec |
| 4 | Phosphate | BONDERITE 958, FA = 0.6, TA = 22.6, $F^-$ = 120 ma, 120° F., 120 sec |
| 5 | Rinse | Deionized water rinse, 65EF, 30 sec |
| 6 | Autodeposit | Autodeposition composition 123-1 or 127-1 |
| 7 | Post-rinse | |
| 8 | Cure | |

Comparative Process D

| Step No. | Task | Description |
|---|---|---|
| 1 | Clean | PARCO Cleaner 1523, 5-7 pts, 120° F., 90 sec |
| 2 | Rinse | Warm water rinse, 120° F., 30 sec |
| 3 | Autodeposit | Autodeposition composition 123-1 or 127-1 |
| 4 | Post-rinse | |
| 5 | Cure | |

Comparative Process A is a conventional nine-stage zinc phosphating system followed by application of an electrocoat primer. Process B (in accordance with the invention) utilizes the first five stages of Process A with formation of an autodeposited coating using a composition containing a reduced level of HF replacing the post-rinse stage (Process A, step 6), followed by rinsing and application of electrocoat paint (Process B, steps 7, 8) for a total of nine stages. Process C (in accordance with the invention) also utilizes the first five stages of Process A followed by autodeposition (Process C, step 6) without the electrocoat paint step 8 (Processes A and B). Comparative Process D eliminates steps 3-5 (notably, the phosphating step) of Process C. Appendix A summarizes various details of the pretreatment-autodeposition-electrocoating process.

The coating experiments showed that all three substrates (CRS, EG and AL) could be coated with an epoxy resin-based coating in an autodeposition process. In addition, the epoxy resin-based coating could be autodeposited over zinc phosphate on CRS, EG and AL using autodeposition compositions containing relatively low HF concentrations. In a multi-metal process such as automotive body assembly, it is believed that the zinc phosphate coating will equalize the reactivity of the surface with respect to the autodeposition composition bath, resulting in an more uniform film build (autodeposited coating weight) on the different metallic surfaces present in a vehicle body.

In order to test the extent of dissolution of the zinc phosphate conversion coating during the autodeposition step of Process C above, experiments were carried out in which panels were prepared according to Process C above. Duplicate panels were processed in which, after step 5, half of the panels were kept for zinc phosphate coating weight measurements. The other half were carried through step 6, where the epoxy resin-based coating was autodeposited over the zinc phosphate conversion coating. After step 6, the panels were not cured as usual but rather were cleaned with acetone to remove the uncured film.

Scanning electron microscope analysis of the acetone-rinsed sample panels showed that a zinc phosphate coating remained. Coating weight analysis showed that the zinc phosphate conversion coating was only dissolved in amounts of 4-12%. This result was surprising, as more extensive leaching of the zinc phosphate conversion coating by the acidic autodeposition composition had been expected.

TABLE 3

| Zinc Phosphate Coating Loss | | | | |
|---|---|---|---|---|
| | Zinc Phosphate Conversion Coating Weight | | | Auto-deposited Film |
| Substrate | Initial (mg/sq. ft) | Final (mg/sq. ft) | % loss | Build* mils |
| CRS | 182 | 174 | 4.4 | 0.5 |
| EG | 192 | 169 | 12.0 | 0.6 |
| AL | 217 | 194 | 10.6 | 0.2 |

*Bath conditions: 5.4% solids, ox-red potential=470 mv, $F^-$=155 microamps (as measured by LINEGUARD 101 meter, corresponding to ca. 0.49 g/l HF), Fe titration=24 ml., 70° F., 120 seconds.

Adhesion and Corrosion Protection Properties

Sample panels of CRS, EG and AL were coated using Processes A, B, C or D at various coating weights and submitted for adhesion and accelerated corrosion testing. The results of those tests are shown in Table 4.

TABLE 4

| Adhesion and Corrosion Test Results | | | | | | | | | |
|---|---|---|---|---|---|---|---|---|---|
| | | | Zinc Phosphate (Coating Wt. (mg/ft$^2$) | | Thickness ($10^{-3}$ in) | Thickness ($10^{-3}$ in) | Crosshatch DI Water Soak[3] | | GM-9540 P[4] 40 cycles |
| Process | Panel ID | Substrate | B-958 | Post- | AD[1] | ED[2] | Initial | Final | Av. Creep(mm) |
| A | A1-3 | CRS | 202 | PLN-90 | 0.00 | 0.85 | 5B | 5B | 1.66 |
| A | B1-3 | CRS | 192 | DIW | 0.00 | 0.86 | 5B | 5B | 3.12 |
| B | C1-3 | CRS | 192 | DIW | 0.33 | 0.96 | 5B | 5B | 8.99 |
| B | D1-3 | CRS | 192 | DIW | 0.31 | 0.61 | 5B | 5B | 7.21 |
| C | E1-3 | CRS | 192 | DIW | 1.44 | 0.00 | 5B | 3B | 8.38 |
| D | F1-3 | CRS | 0 | NA | 1.18 | 0.00 | 5B | 5B | 18.32 |
| A | G1-3 | EG | 209 | PLN-90 | 0.00 | 0.76 | 5B | 5B | 0.76 |
| A | H1-3 | EG | 210 | DIW | 0.00 | 0.83 | 5B | 5B | 1.28 |
| B | I1-3 | EG | 210 | DIW | 0.25 | 0.95 | 5B | 5B | 1.14 |
| B | J1-3 | EG | 210 | DIW | 0.22 | 0.35 | 5B | 5B | 1.15 |
| C | K1-3 | EG | 210 | DIW | 1.30 | 0.00 | 5B | 5B | 1.14 |
| D | L1-3 | EG | 0 | NA | 1.30 | 0.00 | 5B | 1B | 15.41 |
| A | M1-3 | AI | 215 | PLN-90 | 0.00 | 0.76 | 5B | 5B | 1.21 |
| A | N1-3 | AI | 214 | DIW | 0.00 | 0.79 | 5B | 5B | 0.62 |
| B | O1-3 | AI | 214 | DIW | 0.31 | 0.57 | 5B | 5B | 0.42 |
| C | P1-3 | AI | 214 | DIW | 0.90 | 0.00 | 5B | 5B | 0.26 |
| D | Q1-3 | AI | 0 | NA | 0.58 | 0.00 | 5B | 4B | 0.36 |

[1]Autodeposition composition 123-1 or 127-1

[2]PPG ED-5050B electrocoat primer

[3]ASTM D870/ASTM D3359 (5B = best adhesion; 1B = worst adhesion)

[4]Accelerated Corrosion Test GM 9540P, General Motors Corp. 1997. Corrosion rated across the scribe using Corrosion Creepback Test Method GM 9102P, General Motors Corp. 1997 (incorporated herein by reference)

Epoxy resin-based autodeposited coatings can therefore be used as replacements for post rinses and/or electrocoat paint. The autodeposition compositions can coat CRS, EG and AL with or without zinc phosphate. For automotive assembly applications which typically coat multiple substrates simultaneously, however, a zinc phosphate or other pretreatment is desirable in order to equalize the reactivity of the different substrates with the autodeposition composition bath. Zinc phosphate pretreatment followed by autodeposition of the epoxy resin-based coatings described herein can also provide better corrosion protection than either the zinc phosphate conversion coating alone or the autodeposited coating alone.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

Appendix A. Coating Parameters

| | | Pretreatment | | | Autodeposition | | | | | | Electrocoat | | Total Thickness |
|---|---|---|---|---|---|---|---|---|---|---|---|---|---|
| ID | Substrate | Formula | mg/sq.ft | Post Rinse | Formula | ORP[1] (mV) | LINEGUARD 101 Reading (microamps) | % Solids | Fe Titr. (ml) | Coating Thick-ness ($10^{-3}$ in.) | Paint | Thickness ($10^{-3}$ in.) | ($10^{-3}$ in.) |
| A | CRS | B958 | 201.6 | PLN-90 | - | - | - | - | - | - | ED-5050B | 0.85 | 0.85 |
| B | CRS | B958 | 191.8 | DIW | - | - | - | - | - | - | ED-5050B | 0.86 | 0.86 |
| C | CRS | B958 | 191.8 | DIW | 127-1 | 380 | 120 | 13.0 | 22.0 | 0.33 | ED-5050B | 0.96 | 1.29 |
| D | CRS | B958 | 191.8 | DIW | 127-1 | 380 | 160 | 13.0 | 22.0 | 0.31 | ED-5050B | 0.61 | 0.92 |
| E | CRS | B958 | 191.8 | DIW | 123-1 | 475 | 170 | 12.1 | 22.0 | 1.44 | - | - | 1.44 |
| F | CRS | - | - | - | 123-1 | 475 | 170 | 12.1 | 22.0 | 1.18 | - | - | 1.18 |
| G | EG | B958 | 208.7 | PLN-90 | - | - | - | - | - | - | ED-5050B | 0.76 | 0.76 |
| H | EG | B958 | 210.1 | DIW | - | - | - | - | - | - | ED-5050B | 0.83 | 0.83 |
| I | EG | B958 | 210.1 | DIW | 127-1 | 380 | 160 | 13.0 | 22.0 | 0.25 | ED-5050B | 0.95 | 1.20 |
| J | EG | B958 | 210.1 | DIW | 127-1 | 380 | 160 | 13.0 | 22.0 | 0.22 | ED-5050B | 0.35 | 0.57 |
| K | EG | B958 | 210.1 | DIW | 123-1 | 475 | 170 | 12.1 | 22.0 | 1.30 | - | - | 1.3 |
| L | EG | - | - | - | 123-1 | 475 | 170 | 12.1 | 22.0 | 1.3 | - | - | 1.3 |
| M | A1 6111 | B958 | 214.9 | PLN-90 | - | - | - | - | - | - | ED-5050B | 0.76 | 0.76 |

| | | Pretreatment | | | Autodeposition | | | | | | Electrocoat | | Total Thickness |
|---|---|---|---|---|---|---|---|---|---|---|---|---|---|
| ID | Substrate | Formula | mg/sq.ft | Post Rinse | Formula | ORP[1] (mV) | LINEGUARD 101 Reading (microamps) | % Solids | Fe Titr. (ml) | Coating Thick-ness ($10^{-3}$ in.) | Paint | Thickness ($10^{-3}$ in.) | ($10^{-3}$ in.) |
| N | A1 6111 | B958 | 213.5 | DIW | - | - | - | - | - | - | ED-5050B | 0.79 | 0.79 |
| O | A1 6111 | B958 | 213.5 | DIW | 127-1 | 380 | 120 | 13.0 | 22.0 | 0.31 | ED-5050B | 0.57 | 0.88 |
| P | A1 6111 | B958 | 213.5 | DIW | 123-1 | 475 | 170 | 12.1 | 22.0 | 0.90 | - | - | 0.9 |
| Q | A1 6111 | - | - | - | 131-2 | 260 | 30 | 8.0 | | 0.58 | - | | 0.58 |

Appendix B. Adhesion and Corrosion Data

| | | Zinc Phosphate (Coating Wt. (mg/ft$^2$) | | Thickness ($10^{-3}$ in) | Thickness ($10^{-3}$ in) | Crosshatch DI Water Soak[3] | | GM-9540 P[4] |
|---|---|---|---|---|---|---|---|---|
| Panel ID | Substrate | B-958 | Post Rinse | AD[1] | ED[2] | Initial | Final | Av. Creep (mm) |
| A1 | CRS | 202 | PLN-90 | 0.00 | 0.85 | 5B | 5B | 1.61 |
| A2 | CRS | 202 | PLN-90 | 0.00 | 0.85 | 5B | 5B | 1.38 |
| A3 | CRS | 202 | PLN-90 | 0.00 | 0.85 | 5B | 5B | 1.97 |
| B1 | CRS | 192 | DIW | 0.00 | 0.86 | 5B | 5B | 3.30 |
| B2 | CRS | 192 | DIW | 0.00 | 0.86 | 5B | 5B | 3.07 |
| B3 | CRS | 192 | DIW | 0.00 | 0.86 | 5B | 5B | 3.00 |
| C1 | CRS | 192 | DIW | 0.33 | 0.96 | 5B | 5B | 7.84 |
| C2 | CRS | 192 | DIW | 0.33 | 0.96 | 5B | 5B | 5.71 |
| C3 | CRS | 192 | DIW | 0.33 | 0.96 | 5B | 5B | 13.44 |
| D1 | CRS | 192 | DIW | 0.31 | 0.61 | 5B | 5B | 9.38 |
| D2 | CRS | 192 | DIW | 0.31 | 0.61 | 5B | 5B | 5.64 |
| D3 | CRS | 192 | DIW | 0.31 | 0.61 | 5B | 5B | 6.61 |
| E1 | CRS | 192 | DIW | 1.44 | 0.00 | 5B | 2B | 9.38 |
| E2 | CRS | 192 | DIW | 1.44 | 0.00 | 5B | 3B | 7.31 |
| E3 | CRS | 192 | DIW | 1.44 | 0.00 | 5B | 3B | 8.45 |
| F1 | CRS | 0 | NA | 1.18 | 0.00 | 5B | 5B | 19.27 |
| F2 | CRS | 0 | NA | 1.18 | 0.00 | 5B | 5B | 18.36 |
| F3 | CRS | 0 | NA | 1.18 | 0.00 | 5B | 5B | 17.34 |
| G1 | EG60 | 209 | PLN-90 | 0.00 | 0.76 | 5B | 5B | 0.88 |
| G2 | EG60 | 209 | PLN-90 | 0.00 | 0.76 | 5B | 5B | 0.75 |
| G3 | EG60 | 209 | PLN-90 | 0.00 | 0.76 | 5B | 5B | 0.66 |
| H1 | EG60 | 210 | DIW | 0.00 | 0.83 | 5B | 5B | 1.00 |
| H2 | EG60 | 210 | DIW | 0.00 | 0.83 | 5B | 5B | 1.52 |
| H3 | EG60 | 210 | DIW | 0.00 | 0.83 | 5B | 5B | 1.31 |
| I1 | EG60 | 210 | DIW | 0.25 | 0.95 | 5B | 5B | 1.17 |
| I2 | EG60 | 210 | DIW | 0.25 | 0.95 | 5B | 5B | 1.21 |
| I3 | EG60 | 210 | DIW | 0.25 | 0.95 | 5B | 5B | 1.05 |
| J1 | EG60 | 210 | DIW | 0.22 | 0.35 | 5B | 5B | 0.86 |

| | | Zinc Phosphate (Coating Wt. (mg/ft$^2$) | | Thickness ($10^{-3}$ in) | Thickness ($10^{-3}$ in) | Crosshatch DI Water Soak[3] | | GM-9540 P[4] |
|---|---|---|---|---|---|---|---|---|
| Panel ID | Substrate | B-958 | Post Rinse | AD[1] | ED[2] | Initial | Final | Av. Creep (mm) |
| J2 | EG60 | 210 | DIW | 0.22 | 0.35 | 5B | 5B | 1.28 |
| J3 | EG60 | 210 | DIW | 0.22 | 0.35 | 5B | 5B | 1.30 |
| K1 | EG60 | 210 | DIW | 1.30 | 0.00 | 5B | 5B | 1.01 |
| K2 | EG60 | 210 | DIW | 1.30 | 0.00 | 5B | 5B | 0.98 |
| K3 | EG60 | 210 | DIW | 1.30 | 0.00 | 5B | 5B | 1.43 |
| L1 | EG60 | 0 | NA | 1.30 | 0.00 | 5B | 0B | 20.98 |
| L2 | EG60 | 0 | NA | 1.30 | 0.00 | 5B | 0B | 13.36 |
| L3 | EG60 | 0 | NA | 1.30 | 0.00 | 5B | 1B | 11.88 |
| M1 | A1 | 215 | PLN-90 | 0.00 | 0.76 | 5B | 4B | 2.48 |
| M2 | A1 | 215 | PLN-90 | 0.00 | 0.76 | 5B | 5B | 0.82 |
| M3 | A1 | 215 | PLN-90 | 0.00 | 0.76 | 5B | 5B | 0.32 |
| N1 | A1 | 214 | DIW | 0.00 | 0.79 | 5B | 5B | 0.60 |
| N2 | A1 | 214 | DIW | 0.00 | 0.79 | 5B | 5B | 0.85 |
| N3 | A1 | 214 | DIW | 0.00 | 0.79 | 5B | 5B | 0.42 |
| O1 | A1 | 214 | DIW | 0.31 | 0.57 | 5B | 5B | 0.42 |
| O2 | A1 | 214 | DIW | 0.31 | 0.57 | 5B | 5B | 0.42 |
| O3 | A1 | 214 | DIW | 0.31 | 0.57 | 5B | 5B | 0.42 |
| P1 | A1 | 214 | DIW | 0.90 | 0.00 | 5B | 5B | 0.26 |
| P2 | A1 | 214 | DIW | 0.90 | 0.00 | 5B | 5B | 0.26 |
| P3 | A1 | 214 | DIW | 0.90 | 0.00 | 5B | 5B | 0.26 |
| Q1 | A1 | 0 | NA | 0.58 | 0.00 | 5B | 3B | 0.36 |
| Q2 | A1 | 0 | NA | 0.58 | 0.00 | 5B | 5B | 0.36 |
| Q3 | A1 | 0 | NA | 0.58 | 0.00 | 5B | 4B | 0.36 |

[1] Autodeposition composition 123-1 or 127-1

[2] PPG ED-5050B electrocoat primer

[3] ASTM D870/ASTM D3359 (5B = best adhesion; 1B = worst adhesion)

4 Accelerated Corrosion Test GM 9540P, General Motors Corp. 1997. Corrosion rated across the scribe using Corrosion Creepback Test Method GM 9102P, General Motors Corp. 1997 (incorporated herein by reference)

What is claimed is:

1. A process for coating a zinc phosphated metal substrate with an autodeposition coating comprising:

contacting a surface of a zinc phosphated metal substrate with an autodeposition composition comprising water, dispersed epoxy resin particles, a crosslinking agent and hydrofluoric acid, wherein said hydrofluoric acid is maintained within a concentration range in the autodeposition composition during said contacting which is sufficiently low so as to avoid stripping a significant amount of zinc phosphate conversion coating from said zinc phosphated substrate but sufficiently high so as to activate autodeposition of the dispersed epoxy resin particles onto said surface.

2. A process according to claim 1 wherein the concentration of hydrofluoric acid is within the range from about 0.22 g/L to about 0.60 g/L.

3. A process according to claim 1 wherein the concentration of hydrofluoric acid is within the range from about 0.30 g/L to about 0.55 g/L.

4. A process according to claim 1 wherein said dispersed epoxy resin particles are comprised of an epoxy resin containing one or more flexibilizing segments.

5. A process according to claim 4 wherein said epoxy resin is comprised of a glycidyl ether of bisphenol A.

6. A process according to claim 1 wherein said substrate is steel or a steel alloy.

7. A process according to claim 1 wherein said zinc phosphated metal substrate has a zinc phosphate conversion coating on said surface having a coating weight of at least 1500 $mg/m^2$ following said contacting.

8. A process according to claim 1 wherein said zinc phosphated metal substrate has a zinc phosphate conversion coating on said surface having a coating weight which decreases by not more than 20% during said contacting.

9. A process according to claim 1 wherein during said contacting a film comprised of said epoxy resin particles is formed on said surface, said film having a thickness of from about 5 microns to about 50 microns.

10. A process according to claim 9 wherein said film is formed within a period of time of from about 0.5 to about 10 minutes.

11. A process according to claim 1 wherein said metal substrate is a composite part comprised of a first section and a second section, said first section and second section being comprised of different metals.

12. A process for improving the corrosion resistance of a metal substrate comprising:

a). contacting a surface of said metal substrate with a zinc phosphating composition comprised of water, phosphate anions and zinc cations to form a zinc phosphate conversion coating on said surface;

b). contacting the zinc phosphate conversion coating with an autodeposition composition comprising water, dispersed epoxy resin particles, a crosslinking agent and hydrofluoric acid, wherein said hydrofluoric acid is maintained within a concentration range in said autodeposition composition during said contacting which is sufficiently low so as to avoid stripping a significant amount of said zinc phosphate conversion coating from said surface but sufficiently high so as to activate autodeposition of the dispersed epoxy resin particles onto said surface.

13. A process for coating a zinc phosphated metal substrate with an autodeposition coating comprising:

a) contacting a surface of a zinc phosphated metal substrate with an autodeposition composition comprising water, dispersed epoxy resin particles, a crosslinking agent and hydrofluoric acid etching agent;

b) etching zinc phosphate at said surface with the hydrofluoric acid etching agent for a time sufficient to thereby activate autodeposition of the dispersed epoxy resin particles onto the surface;

c) maintaining the hydrofluoric acid etching agent within a concentration range of 0.22 to 0.6 g/L in the autodeposition composition during steps a) and b) such that etching more than 20% of the zinc phosphate conversion coating from said zinc phosphated substrate is avoided; and d) rinsing the zinc phosphated metal substrate after step c).

14. The process according to claim 13 wherein the autodeposition of the dispersed epoxy resin particles onto the surface forms a film comprised of said epoxy resin particles, said film having a thickness of from about 5 microns to about 50 microns.

15. The process according to claim 14 wherein said film is formed within a period of time of from about 0.5 to about 10 minutes.

16. The process according to claim 14 wherein said zinc phosphated metal substrate has a zinc phosphate conversion coating on said surface having a coating weight of at least 1500 $mg/m^2$ following said rinsing.

17. The process according to claim 13 wherein said zinc phosphated metal substrate has a zinc phosphate conversion coating on said surface having a coating weight of at least 1500 mg/in following said rinsing.

18. The process according to claim 17 wherein the concentration of hydrofluoric acid is within the range from about 0.30 g/L to about 0.55 g/L.

19. The process according to claim 18 wherein said metal substrate is a composite part comprised of a first section and a second section, said first section and second section being comprised of different metals.

* * * * *